US005294041A

United States Patent [19]

Whiteside

[11] Patent Number: 5,294,041

[45] Date of Patent: Mar. 15, 1994

[54] CONTINUOUS BUSINESS FORMS AND MAILERS FORMED THEREFROM

[75] Inventor: Robert Whiteside, Leicestershire, Great Britain

[73] Assignee: Moore Business Forms, Inc., Grand Island, N.Y.

[21] Appl. No.: 19,836

[22] Filed: Feb. 19, 1993

[51] Int. Cl.[5] ..... B65D 27/10

[52] U.S. Cl. ..... 229/69; 229/92.1

[58] Field of Search ..... 229/69; 282/11.5 A, 282/11.5 R

[56] References Cited

U.S. PATENT DOCUMENTS

| | | | |
|---|---|---|---|
| 4,063,398 | 12/1977 | Huffman | 53/31 |
| 4,221,267 | 7/1980 | Skovgaard | 229/69 |
| 4,754,915 | 7/1988 | Steidinger | 229/69 |
| 4,824,142 | 4/1989 | Dossche | 282/11.5 A |
| 4,830,269 | 5/1989 | Jenkins | 229/69 |
| 4,896,823 | 1/1990 | Taylor | 229/73 |
| 4,928,875 | 5/1990 | Hutchinson | 229/92.1 |
| 5,038,999 | 8/1991 | Dicker | 229/69 |

FOREIGN PATENT DOCUMENTS

| | | |
|---|---|---|
| 0225135 | 6/1987 | European Pat. Off. . |
| 1594798 | 8/1981 | United Kingdom . |

*Primary Examiner*—Joseph Man-Fu Moy
*Attorney, Agent, or Firm*—Nixon & Vanderhye

[57] ABSTRACT

A business form intermediate comprises a sheet that is C-folded first about a first fold line and then a second fold line to define a mailer. The business form has first, second and third panels with an outgoing address area on the first face of the second panel, and an O.P.A.S. patch on the first face of the first panel. The patch obscures a PIN number or other confidential information underneath it. Pressure seal adhesive formed along the margins of the paper sheet of the intermediate holds the panels together once C-folded. Masking is applied on panel faces as necessary in order to obscure all interior information of the mailer.

20 Claims, 3 Drawing Sheets

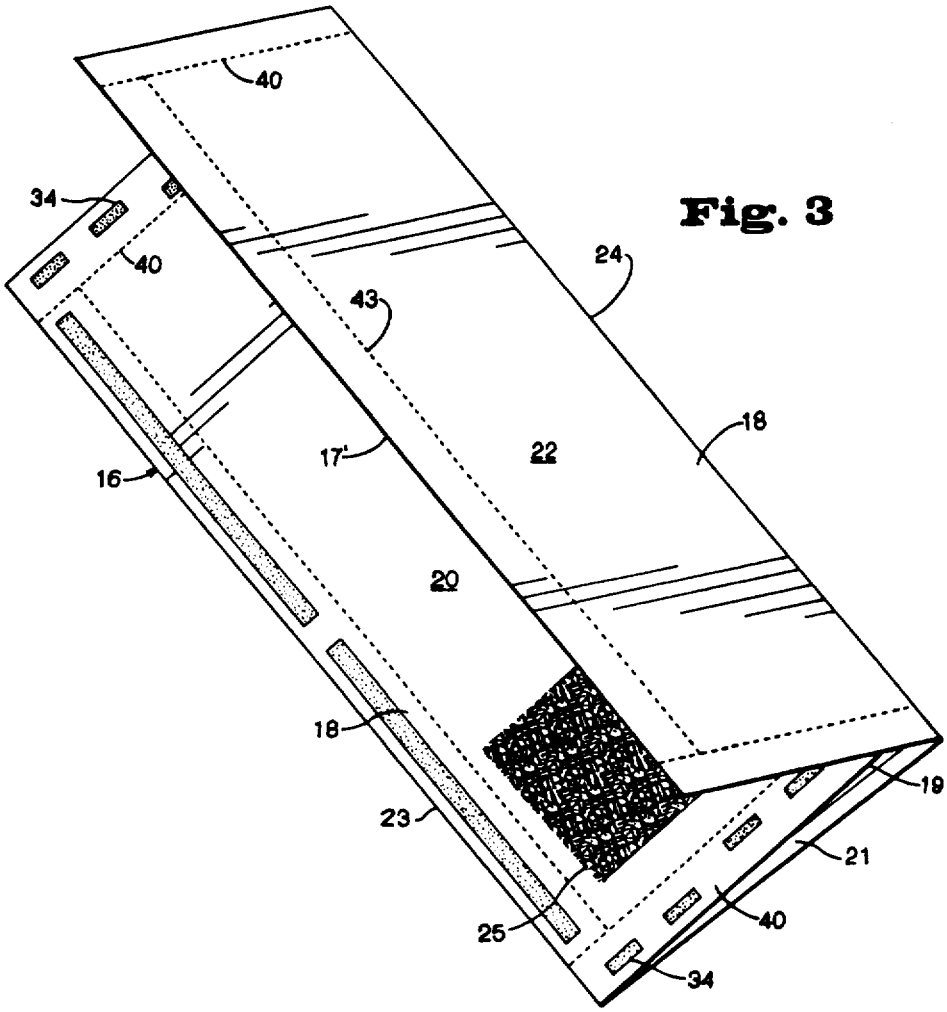
Fig. 3
Fig. 4
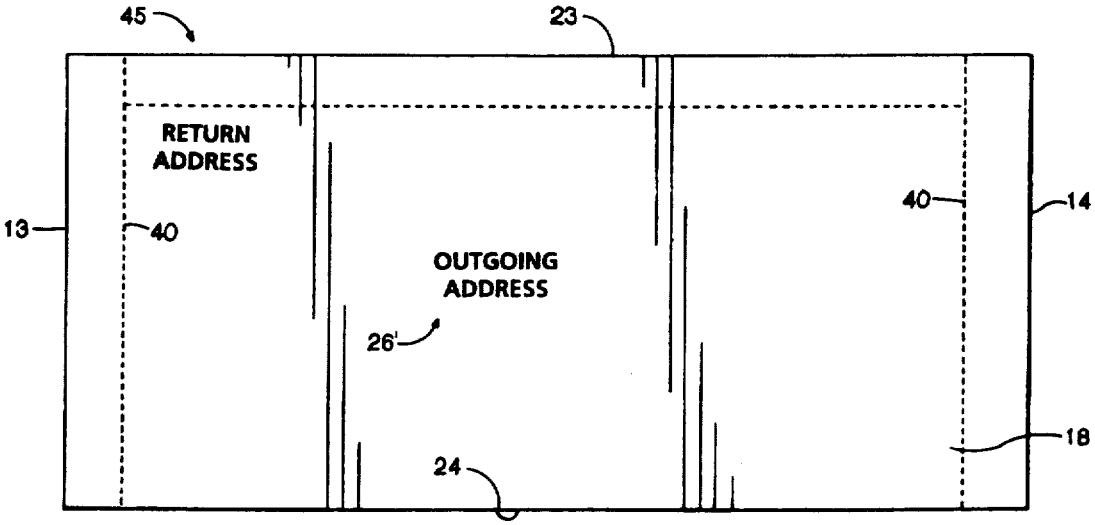

CONTINUOUS BUSINESS FORMS AND MAILERS FORMED THEREFROM

BACKGROUND AND SUMMARY OF THE INVENTION

This invention relates to continuous business forms assemblies (business form intermediates) which are subsequently processed to become individual sealed mailers and is particularly concerned with continuous business forms assemblies comprising a plurality of individual business forms in continuous format and each intended to carry confidential information such as a personal identification number (PIN number) at a predetermined position on the form so that it will be hidden when printed on the form and will be inside the sealed mailer.

Conventionally continuous business forms have longitudinal marginal edge portions provided with feed holes for accurate correlation with a printer or other processing machines and are divided into a number of form or mailer lengths by transverse lines of perforation. Such continuous business forms are printed with all the information common to all forms, are provided with all adhesive necessary for forming sealed mailers, are provided with any patches or windows required and are then fan folded and boxed in appropriate lengths for dispatch to a user who wishes to personalize individual form lengths, form them into mailers and dispatch them to customers. In the particular case of forwarding their PIN numbers to customers this user would be a bank or credit card issuing organization.

In U.S. Pat. No. 4,824,142 (the disclosure of which is hereby incorporated by reference herein) there is described a continuous business form assembly for recording and dispatching PIN numbers. A continuous web is divided into form lengths and an area of each form length intended to receive a customer's PIN number has adhered thereto a masking patch of the type known as an O.P.A.S. patch. Such a patch has a top surface printed with a masking pattern, and a lower surface coated with a CB (coated back) coating and the area receiving the patch is coated with a CF (coated front) coating to act with the CB coating on the patch to produce on the area a reproduction of a PIN number which has been impacted on the top surface of the patch. Only when the patch is peeled away can the number be seen.

The web of that assembly is formed into mailers by one of two methods; either the web is plow folded about a longitudinal central line into two overlying panels which are adhered together to from each mailer or two separate webs are collated together and secured around the edges of each form length.

As the patch requires impact printing to transfer the impression of the PIN number onto the web area beneath the patch and an impact printer can only print on one side of the web, the addressee details must be printed on the same side of the web and in the prior art such a system requires the address to be viewed through a window.

According to the present invention, an improved continuous business form assembly (intermediate) suitable for impact printing to receive PIN numbers (or other confidential information) and personalized details of addressees and which can then be folded and sealed to provide sealed final business forms (mailers) in which the PIN numbers will be enclosed, is provided.

According to one aspect of the present invention a business form intermediate is provided. The intermediate has the following elements: A sheet having first and second opposite faces, parallel first and second edges, and parallel third and fourth edges perpendicular to the first and second edges. First and second fold lines parallel to the first and second edges, and dividing the sheet into first, second, and third panels, the first panel bordered by the first edge and first fold line, and the second panel between the first and third panels. One of the second and third panels has an outgoing address area formed on the first face thereof. The first panel has a patch, with inner and outer surfaces, adhesively secured to the first face thereof, the patch having an outer surface with masking means associated therewith, and transfer means provided between the patch inner surface and the first panel first face. And, adhesive patterns associated with the panels for holding the business form when folded into a C-fold configuration, folded about the first fold line first, and then the second fold line, to provide the first panel first surface covered by the third panel so that the patch is not visible from the exterior of the formed mailer.

Preferably the panel having the outgoing address area formed on its first face is the second panel, and the adhesive patterns comprise cooperating adhesive patterns formed on the first panel first face and third panel second face, and cooperating adhesive patterns on the second and first panels second faces. The adhesive patterns preferably comprise pressure seal adhesive. Masking indicia is provided on the third panel for minimizing the transparency and translucency thereof, such is on both faces or merely the second face. Also masking indicia is printed on the second face of the first panel.

The business form intermediate is preferably in continuous format, with like sheets connected along the first and second edges thereof by lines of weakness (e.g. perforations). Also indicia describing the utilization of a PIN number imaged on the first panel first face adjacent the patch is preferably provided. The transfer means typically comprises CB and CF coatings on the patch and a portion of the first panel first face. Lines of weakness (perforations) are disposed parallel to the third and fourth edges interior of the patterns of adhesive for allowing ready opening of the mailer once C-folded with the panels thereof adhesively secured together.

The invention also comprises a business form per se, namely a mailer type business form. The components of the business form are A sheet having first, second and third panels, each with a first face and a second face, C-folded about fold lines so that said third panel second face engages the first panel first face and the first panel second face engages the second panel second face. One of the second and third panels having an outgoing address area formed on the first face thereof. The first panel having a patch, with inner and outer surfaces, adhesively secured to the first face thereof, the patch having an outer surface with masking means associated therewith, and transfer means provided between the patch inner surface and the first panel first face. And, adhesive patterns holding the second panel second face and first panel second face, and third panel second face and first panel first face, together in the C-folded configuration.

The business form according to the invention typically comprises outgoing address indicia printed in the outgoing address area (e.g. on the second panel first face) and a PIN number on the first panel first face covered by the patch.

It is the primary object of the present invention to provide an advantageous continuous business form intermediate, and C-folded mailer type business form produced therefrom, that is easy to print (including a PIN number which is maintained confidential), and then make into a mailer. This and other objects of the invention will become clear from an inspection of the detailed description of the invention and from the appended claims.

BRIEF DESCRIPTION OF THE DRAWINGS

FIG. 3 shows diagrammatically one mailer length being folded to form a sealed mailer; and FIG. 4 is a top plan view of an exemplary mailer according to the invention after the panels are C-folded and adhesively secured together.

DETAILED DESCRIPTION OF THE DRAWINGS

Figure 1:
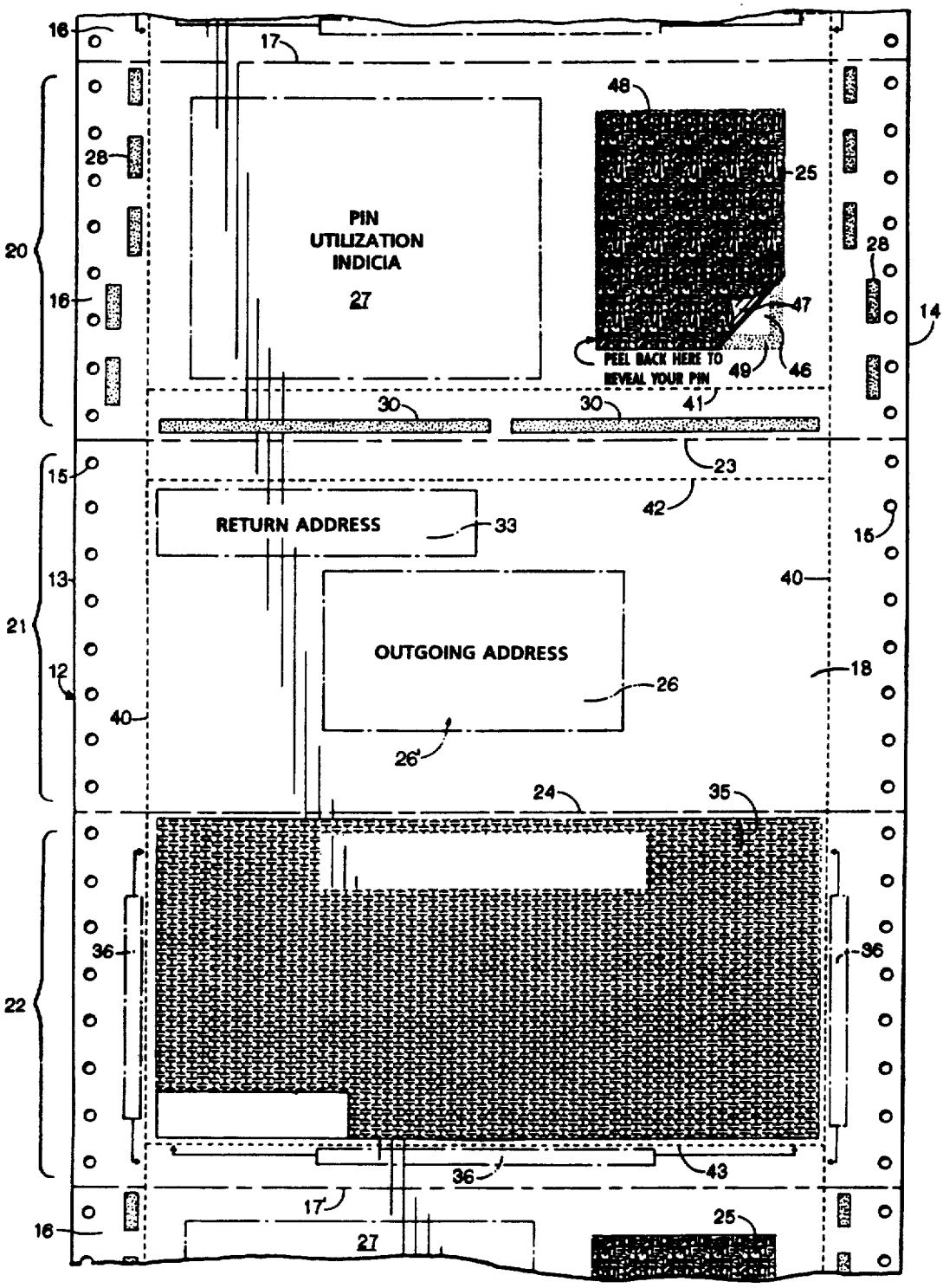
FIG. 1 shows one side of one mailer length forming part of a continuous business form intermediate according to the invention.

A continuous business form intermediate according to the invention comprises a continuous web 12 having longitudinal edges 13, 14 formed with marginal feed apertures 15 for guiding and accurately correlating the web with a printer or other processing machines. The web is divided, in known manner, into a plurality of form lengths 16 by transverse lines of weakness (e.g. perforations 17, 17') defining first and second edges, each form length comprising a sheet of paper designed to form an individual sealed mailer. The web has a front (first) face 18 shown in FIG. 1 and a rear (second) face 19 shown in FIG. 2 and is printed on both sides with information common to all forms/mailer lengths.

Figure 2:
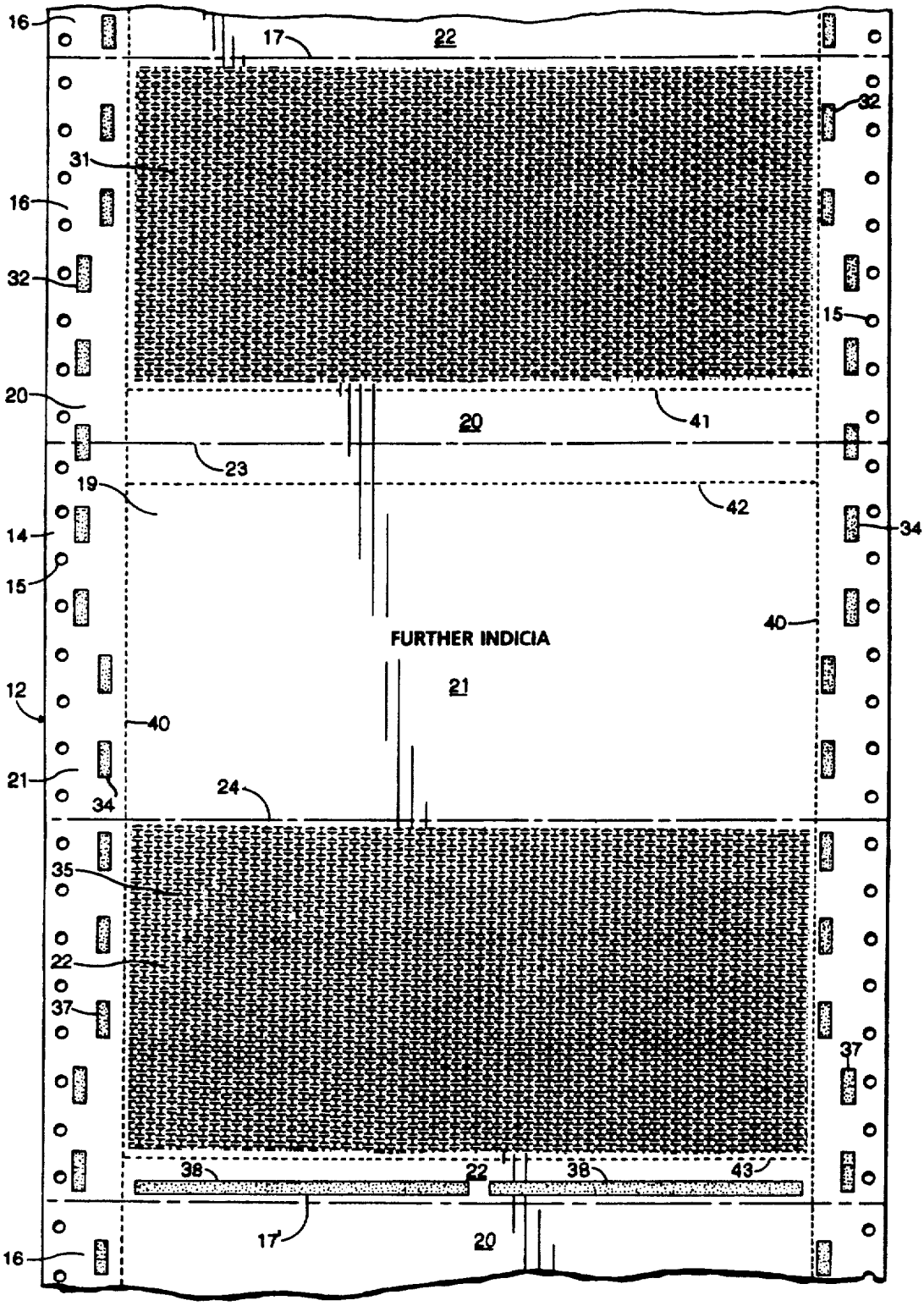
FIG. 2 shows the other side of the mailer length of FIG. 1 forming parts of a continuous business form intermediate.

Each form intermediate (sheet) is intended to be C-folded to form a mailer type business form 45 (see FIG. 4) and for this purpose is divided into three substantially equal panels 20, 21, 22 by first and second fold lines indicated diagrammatically at 23 and 24 in FIGS. 1 and 2. The first panel 20 has on its face 18 an area 46 (see FIG. 1) covered by a masking O.P.A.S patch 25 bearing transfer material. For example CB transfer material 47 is on the rear face of patch 25, cooperating with CF material (not seen) on area 46 of face 18 of panel 20. Masking indicia 48 is printed on the top face of patch 25. That is, the patch 25 per se is as in U.S. Pat. No. 4,824,142.

The masking patch 25 is adhered to the edges of the area 46 so that it can be peeled off to reveal visible information transferred to the area by impact printing on the masked surface of the patch, as by adhesive 49 (FIG. 1). The masking 48 on the patch 25 normally obscures any printing thereon but, if necessary, the impact printing on the patch can be made without using a printing ribbon or ink.

The second panel 21 has an area 26 adapted to receive personalized details of an addressee (an outgoing address area) also to be impact printed on the first face 18 of the sheet. Outgoing addressee indicia 26' ultimately is printed on area 26. Alternatively, the area 26 could be on the first face 18 of third panel 22.

Initially the manufacturer of the continuous business form will print on both sides of the form all information common to all form lengths, will apply the patches 25 and will apply adhesive patterns 28, 36, etc. necessary for forming the eventual sealed mailers 45. The manufacturer will then fan fold the web along perforation lines 17, 17' (to become first and second edges of each mailer 45), and separate and box the form intermediate in lengths suitable for conveyance to a user. Such continuous form intermediates are supplied to a user such as a bank who passes the forms continuously through an impact printer so as to supply the details of the PIN number and addressee details to each individual form length. The forms are then continuously burst, folded and sealed and dispatched to individual customers.

In the arrangement shown each mailer length (sheet) is preprinted with information and supplied with adhesive as follows:

First Panel 20

Face 18—in area 27 instructions (indicia) for viewing, utilizing, and retaining confidential the PIN number; along both marginal edges staggered discreet patches of pressure seal adhesive 28 and along the transverse first edge 17 a line of pressure seal adhesive 30. Face 19—masking printing 31 at least in an area corresponding with the position of the patch 25; and discrete staggered areas of pressure seal adhesive 32 along the longitudinal edges.

Second Panel 21

Face 18—in an area 33 details of the sender, and wording such as "Private and Confidential" and "See reverse side for opening instructions"; no adhesive is on this side of the form as it forms one outside surface of the eventual sealed mailer. The other face 19 of the panel 21 is available for any message ("further indicia") to the outgoing addressee and is formed with staggered discrete areas of pressure seal adhesive 34 along its longitudinal marginal areas.

Third Panel 22

Face 18—forms the other outside side of the sealed mailer 45 and is covered with masking printing 35 and instructions at 36 for opening the mailer 45. On its other face 19, the panel 22 is also printed with masking printing 35 and has discrete staggered areas 37 of pressure seal adhesive along its longitudinal marginal edges and a line of pressure seal adhesive 38 along its second edge 17'.

Once the form intermediate has been printed by the user with the personalized details the form is passed through a burster to separate each form intermediate length from the continuous web, and is C-folded (see FIG. 3) first along line 23 to bring first face 19 of first panel 20 into contact with second face 19 of second panel 21, and then along line 24 to bring second face 19 of third panel 22 into contact with first face 18 of first panel 20. The areas of pressure seal adhesive will then all come into contact with an area of pressure seal adhesive on an adjacent panel and the form is passed through a commercial pressure edge sealing device which applies pressure to activate the adhesive and provide sealed mailers 45 (FIG. 4), which have the patches 25 inside and the addressee information in area 26 on the outside.

The forms 45 preferably are provided with longitudinal perforation lines 40 along each marginal edge inside the lines of adhesive and with transverse perforation lines 41, 42 and 43 on the panels 20, 21 and 22 respectively inside the transverse lines of adhesive 30 and 38 and the transverse marginal portion on panel 21 which will correspond with these lines of adhesive when the mailer is folded and sealed.

The sealed mailer is opened by the eventual customer by tearing along the longitudinal perforation lines 40 to remove the marginal longitudinal edge portions and then tearing along the coinciding lines 41, 42 and 43 to remove these transverse marginal edge portions. The result is that the panel 20 bearing the PIN number under patch 25 is completely separated from the panel 21 bearing the addressee details, and the patch 25 removed to reveal the PIN number.

The patterns of adhesive 32, 34, 37, etc. are staggered and spaced so that adhesive on any form length does not contact adhesive on any adjacent form length when the continuous form is fan folded about the perforation lines/edges 17, 17'.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A business form intermediate comprising:

a sheet having first and second opposite faces, parallel first and second edges, and parallel third and fourth edges perpendicular to said first and second edges;

first and second fold lines parallel to said first and second edges, and dividing said sheet into first, second, and third panels, said first panel bordered by said first edge and first fold line, and said second panel between said first and third panels;

one of said second and third panels having an outgoing address area formed on said first face thereof;

said first panel having a patch, with inner and outer surfaces, adhesively secured to said first face thereof, said patch having an outer surface with masking means associated therewith, and transfer means provided between said patch inner surface and said first panel first face; and adhesive patterns associated with said panels for holding said business form in a C-fold configuration when folded about said first fold line first, and then said second fold line, to provide said first panel first surface covered by said third panel so that said patch is not visible from the exterior of a formed mailer.

2. A business form intermediate as recited in claim 1 wherein said panel having an outgoing address area formed on said first face thereof comprises said second panel.

3. A business form intermediate as recited in claim 2 wherein said adhesive patterns comprise cooperating adhesive patterns formed on said first panel first face and said third panel second face.

4. A business form intermediate as recited in claim 3 wherein the adhesive of said adhesive patterns comprises pressure seal adhesive.

5. A business form intermediate as recited in claim 3 wherein said adhesive patterns further comprise cooperating adhesive patterns on said second and first panel second faces.

6. A. business form intermediate as recited in claim 2 further comprising masking indicia provided on said third panel for minimizing the transparency and translucency of said third panel.

7. A business form intermediate as recited in claim 1 further comprising indicia describing the utilization of a PIN number imaged on said first panel first face adjacent said patch.

8. A business form intermediate as recited in claim 1 in continuous format, with like sheets connected along said first and second edges thereof by lines of weakness.

9. A business form intermediate as recited in claim 1 further comprising indicia imaged on said second panel second face, and outgoing address indicia in said outgoing address area.

10. A business form intermediate as recited in claim 1 wherein said transfer means comprises CB and CF coatings on said patch and a portion of said first panel first face.

11. A business form intermediate as recited in claim 1 further comprising masking indicia printed on said second face of said first panel.

12. A business form intermediate as recited in claim 1 further comprising lines of weakness disposed parallel to said third and fourth edges, interior of said patterns of adhesive, for allowing ready opening of the mailer formed by C-folding, with the panels thereof adhesively secured to each other.

13. A business form intermediate as recited in claim 1 further comprising masking indicia printed on said second face of said third panel.

14. A business form comprising:

a sheet having first, second and third panels, each with a first face and a second face, C-folded about fold lines so that said third panel second face engages said first panel first face and said first panel second face engages said second panel second face;

one of said second and third panels having an outgoing address area formed on said first face thereof;

said first panel having a patch, with inner and outer surfaces, adhesively secured to said first face thereof, said patch having an outer surface with masking means associated therewith, and transfer means provided between said patch inner surface and said first panel first face; and adhesive patterns holding said second panel second face and first panel second face, and third panel second face and first panel first face, together in said C-folded configuration.

15. A business form as recited in claim 14 wherein said panel having an outgoing address area formed on said first face thereof comprises said second panel.

16. A. business form intermediate as recited in claim 15 further comprising masking indicia provided on said third panel for minimizing the transparency and translucency of said third panel.

17. A business form intermediate as recited in claim 14 wherein said transfer means comprises CB and CF coatings on said patch and a portion of said first panel first face.

18. A business form as recited in clam 14 further comprising outgoing address indicia in said outgoing address area, and a PIN number on said first panel first face covered by said patch.

19. A business form intermediate as recited in claim 14 further comprising masking indicia printed on said second face of said third panel.

20. A business form intermediate as recited in claim 19 further comprising masking indicia printed on said second face of said first panel.

* * * * *